US007320627B2

(12) United States Patent
Skarlupka et al.

(10) Patent No.: US 7,320,627 B2
(45) Date of Patent: Jan. 22, 2008

(54) DEFORMABLE ELECTRICAL CONNECTOR

(75) Inventors: Michael J. Skarlupka, Freeport, IL (US); Matthew J. Brose, Pecatonica, IL (US); David S. Evans, Lena, IL (US)

(73) Assignee: Honeywell International Inc., Morristown, NJ (US)

( * ) Notice: Subject to any disclaimer, the term of this patent is extended or adjusted under 35 U.S.C. 154(b) by 73 days.

(21) Appl. No.: 11/397,233

(22) Filed: Apr. 3, 2006

(65) Prior Publication Data

US 2007/0232137 A1 Oct. 4, 2007

(51) Int. Cl.
*H01R 4/50* (2006.01)

(52) U.S. Cl. ..... 439/863; 439/82; 439/751

(58) Field of Classification Search ..... 439/82, 439/751, 733.1, 444, 863, 825, 869, 78, 876
See application file for complete search history.

(56) References Cited

U.S. PATENT DOCUMENTS

| | | | | |
|---|---|---|---|---|
| 2,814,024 | A * | 11/1957 | Narozny | 439/58 |
| 2,877,441 | A * | 3/1959 | Narozny | 439/857 |
| 3,824,556 | A | 7/1974 | Berkovits et al. | |
| 3,953,103 | A * | 4/1976 | Mathis | 439/866 |
| 4,097,101 | A * | 6/1978 | Holt et al. | 439/82 |
| 4,509,808 | A * | 4/1985 | Hellgren | 439/83 |
| 4,526,429 | A * | 7/1985 | Kirkman | 439/82 |
| 4,652,250 | A * | 3/1987 | Reswick | 474/52 |
| 5,427,546 | A * | 6/1995 | Garritano et al. | 439/502 |
| 5,653,601 | A * | 8/1997 | Martucci et al. | 439/82 |
| D435,022 | S | 12/2000 | Thomas et al. | D13/173 |
| 6,168,441 | B1 * | 1/2001 | Buchart | 439/82 |
| 6,210,181 | B1 * | 4/2001 | Tomita | 439/82 |
| 6,220,902 | B1 | 4/2001 | Ivandic et al. | |
| D448,008 | S | 9/2001 | Singer | D13/173 |
| 6,420,669 | B1 | 7/2002 | Shenker et al. | 200/339 |
| 6,791,047 | B1 | 9/2004 | Skarlupka et al. | 200/335 |
| 6,943,310 | B2 | 9/2005 | Eisenhower | 200/339 |

* cited by examiner

*Primary Examiner*—Neil Abrams
*Assistant Examiner*—Harshad C Patel
(74) *Attorney, Agent, or Firm*—Kermit D. Lopez; Luis M. Ortiz; William B. Shelby

(57) ABSTRACT

A secure electrical connector for wire conductors. An electrical connector can be pressed into place in the base of a toggle switch and includes an electrically conductive cylinder having a slot in the forward end of the electrical connector. The wire conductor is inserted into the longitudinal hole through the cylinder and protrudes from the forward end. The lateral slot deforms inward around the wire conductor as the connector is pressed in a screw terminal, securely holding the wire conductor in place.

20 Claims, 5 Drawing Sheets

DEFORMABLE ELECTRICAL CONNECTOR

TECHNICAL FIELD

Embodiments are generally related to electrical connectors. Embodiments are also related to the field of switches utilized in commercial, industrial and consumer applications. Embodiments additionally relate to toggle switches.

BACKGROUND

A toggle switch is a switch in which a projecting lever with a spring is used to open or to close an electric circuit. Toggle switches of various types have long been utilized to control power in domestic, commercial, industrial, and military applications for operating various electrical devices and equipment.

Known toggle switches typically are manufactured with a housing that contains electrical contacts and is fitted with a manually operable handle to switch power to externally mounted terminals. Common toggle switches are standardized in terms of their mounting configurations such that they can readily be installed in wall-mounted electrical boxes, for example, with only the use of two screws. Typically, screw terminals are positioned on the sides of the switch housing such that connection can be easily made to electrical wires of suitable size to deliver power to electrical devices or equipment.

The process used for attaching a leaded wire to the back of a toggle switch requires attaching the leaded wire with a terminal already crimped on. To make a secure connection, the back of the switch and the wires with the terminal are then potted. The crimped terminals, wires and potting add a significant depth to the back of the toggle switch.

A need thus exists for a cost effective apparatus and method of attaching wires securely to the back of a toggle switch while maintaining a low profile to the housing, which can also eliminate the need for securing the wires by potting.

BRIEF SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is, therefore, one aspect to provide for an improved method and apparatus for attaching wires to the back of a toggle switch.

It is another aspect to provide for a method and apparatus for attaching wires to the back of a toggle switch with a lower profile.

The aforementioned aspects and other objectives and advantages can now be achieved as described herein. An electrical connector apparatus is disclosed, which includes an electrically conductive cylinder wherein the electrically conductive cylinder contains an aft end and a forward end. The electrical connector apparatus also incorporates the use of a lateral slot formed from the walls of the forward end of the electrically conductive cylinder. A longitudinal hole can also be formed through and from the electrically conductive cylinder, whereby an electrical wire, with the insulation removed, is insertable into the aft end of the electrically conductive cylinder, and wherein the wire is inserted until the wire conductor of the electrical wire extends beyond the forward end of the electrically conductive cylinder and between the walls of the lateral slot in order to achieve a secure electrical connector apparatus.

In accordance with one embodiment, the electrical connector comprises an electrically conductive cylinder into which a wire conductor is inserted. The connector has a lateral slot cut into it on the forward end which will deform inward to grip the wire conductor when the connector is pressed in a toggle switch screw base. The connector forward end is beveled to allow easier insertion into the toggle switch screw base and also to facilitate the slotted end of the electrical connector to deform around the wire conductor. The act of inserting the connector into the toggle switch base both ensures electrical continuity by completing the electrical connection and secures both the electrical connector to the toggle switch and the wire conductor to the electrical connector by deforming around it.

The slotted forward end of the connector has knurling on the exterior, interfering with the toggle switch screw threads. This plurality of knurls is longitudinal, i.e. parallel to the axis of the longitudinal hole formed in the electrical connector. This interference between the plurality of knurls and the screw threads securely holds the electrical connector in place on the back of the toggle switch. A flange is provided on the connector to facilitate pressing the connector into the screw terminal. The electrical connector may be pressed into place in the toggle switch base by the use of a press.

The combination of providing both a secure connection to the toggle switch base while securely gripping the wire conductor results in a connection that does not require a crimped-on terminal. The electrical potting may also be eliminated, significantly reducing the depth of the back of the toggle switch.

BRIEF DESCRIPTION OF THE DRAWINGS

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

The particular values and configurations discussed in these non-limiting examples can be varied and are cited merely to illustrate at least one embodiment and are not intended to limit the scope thereof.

Figure 1:
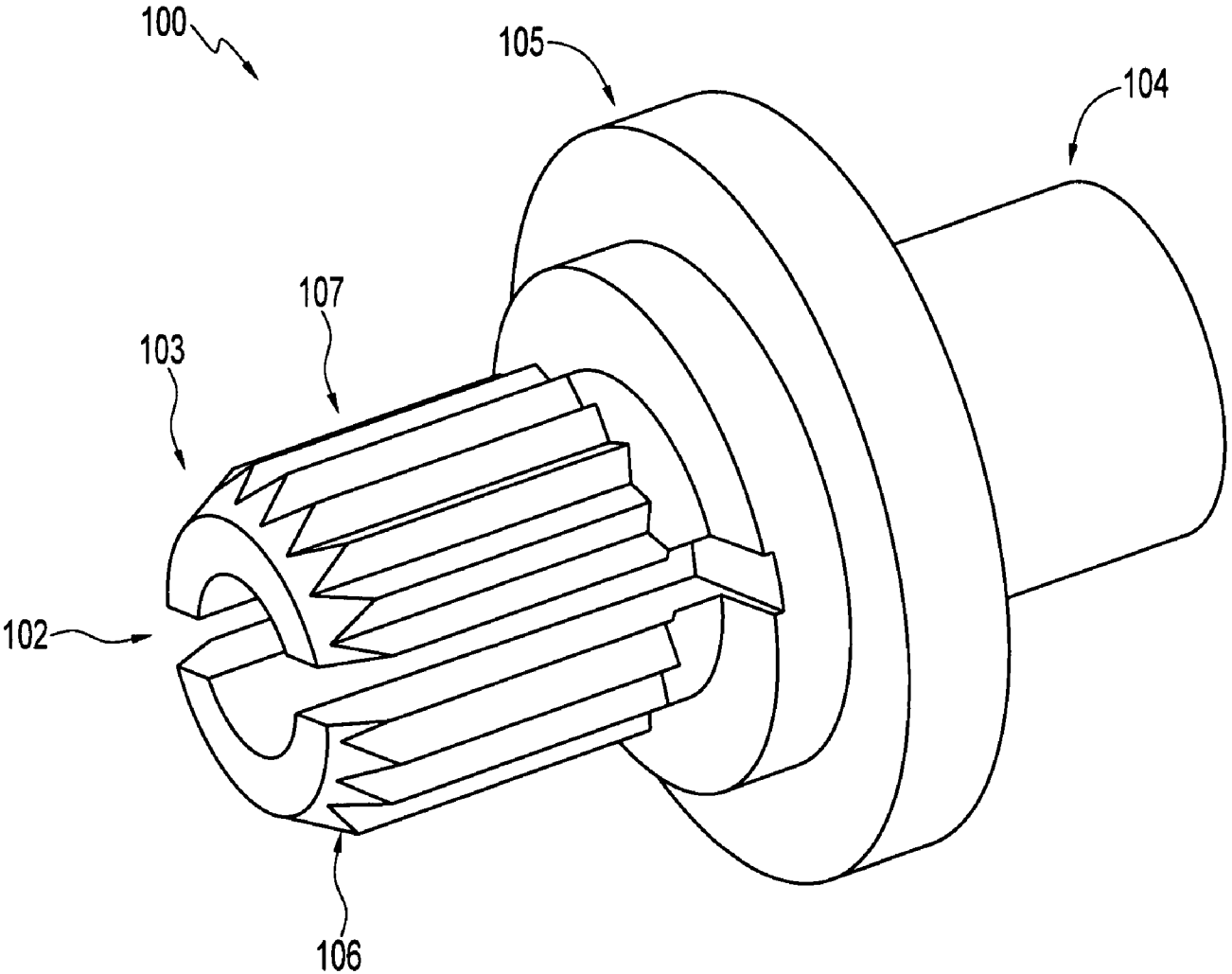
FIG. 1 illustrates a perspective view of an electrical connector apparatus, which can be implemented in accordance with a preferred embodiment.
Figure 2:
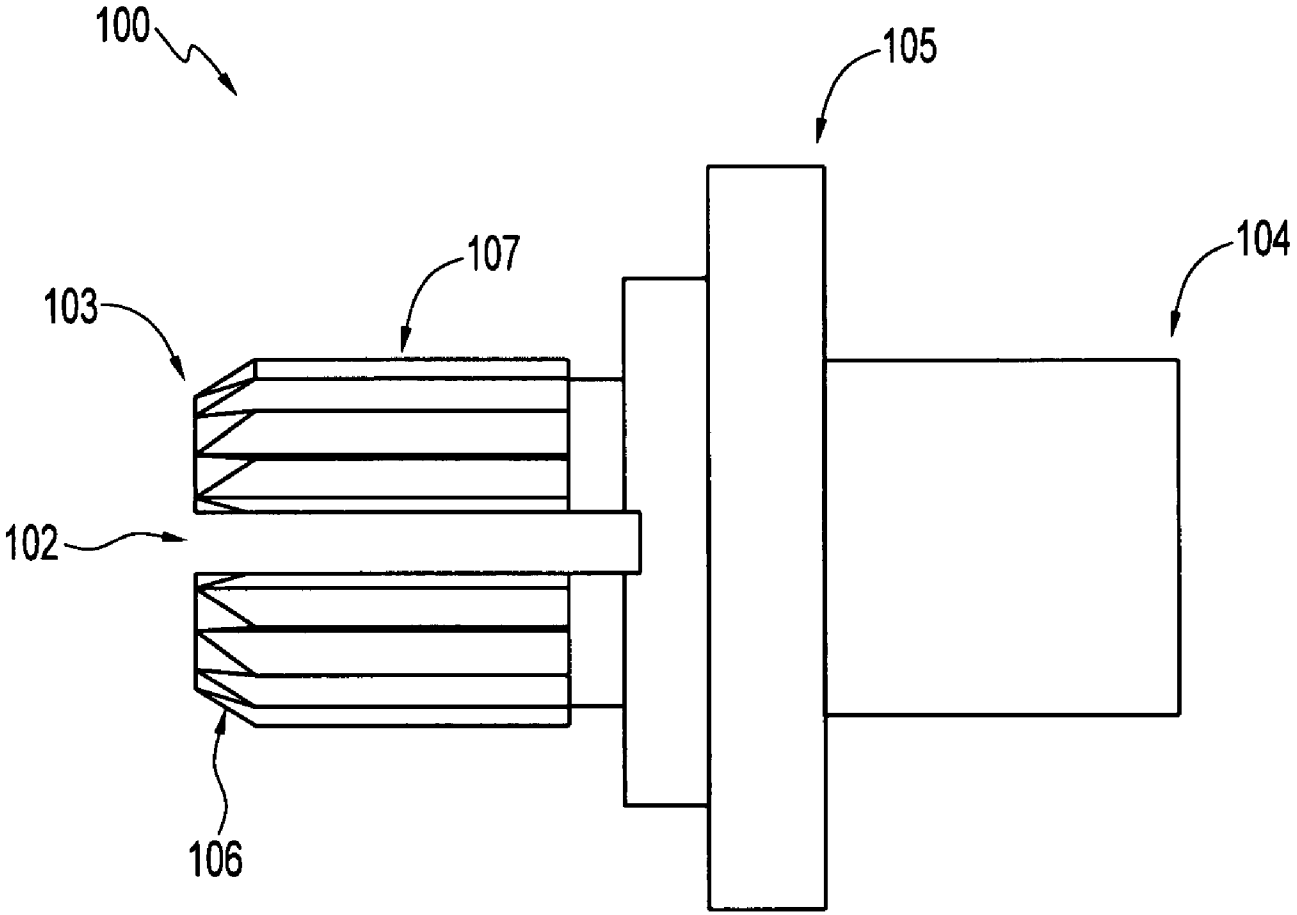
FIG. 2 illustrates a longitudinal side view of the electrical connector apparatus depicted in FIG. 1, which can be implemented in accordance with a preferred embodiment.
Figure 4:
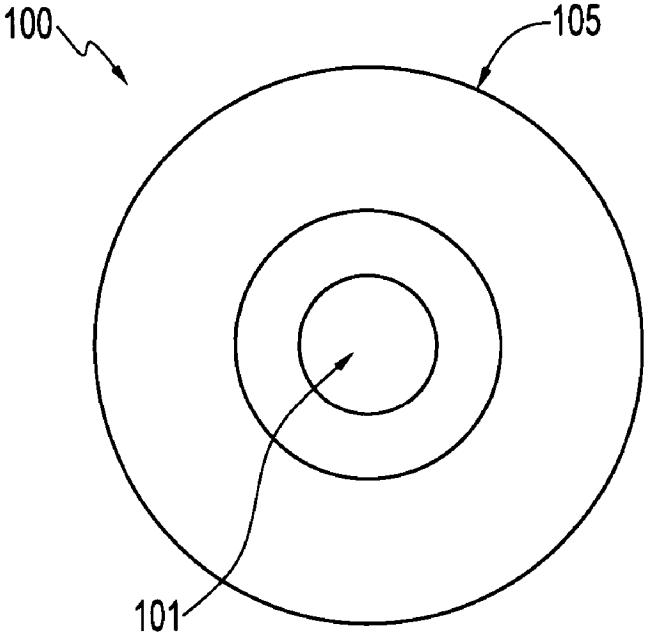
FIG. 4 illustrates a lateral aft view of the electrical connector apparatus depicted in FIGS. 1-3, which can be implemented in accordance with a preferred embodiment.
Figure 3:
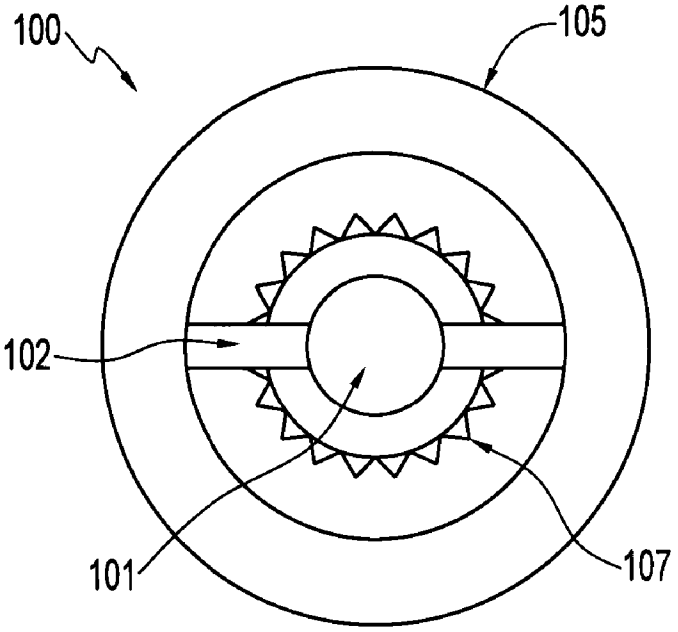
FIG. 3 illustrates a lateral forward view of the electrical connector apparatus depicted in FIGS. 1-2, which can be implemented in accordance with a preferred embodiment.

FIG. 1 illustrates a perspective view of an electrical connector 100, which can be implemented in accordance with an embodiment of the present invention. FIG. 2 illustrates a longitudinal side view of the electrical connector apparatus, 100 depicted in FIG. 1, which can be implemented in accordance with a preferred embodiment. FIG. 3 illustrates a lateral forward view of the electrical connector apparatus, 100 depicted in FIGS. 1-2, which can be implemented in accordance with a preferred embodiment. FIG. 4 illustrates a lateral aft view of the electrical connector apparatus, 100 depicted in FIGS. 1-3, which can be implemented in accordance with a preferred embodiment.

Figure 5:
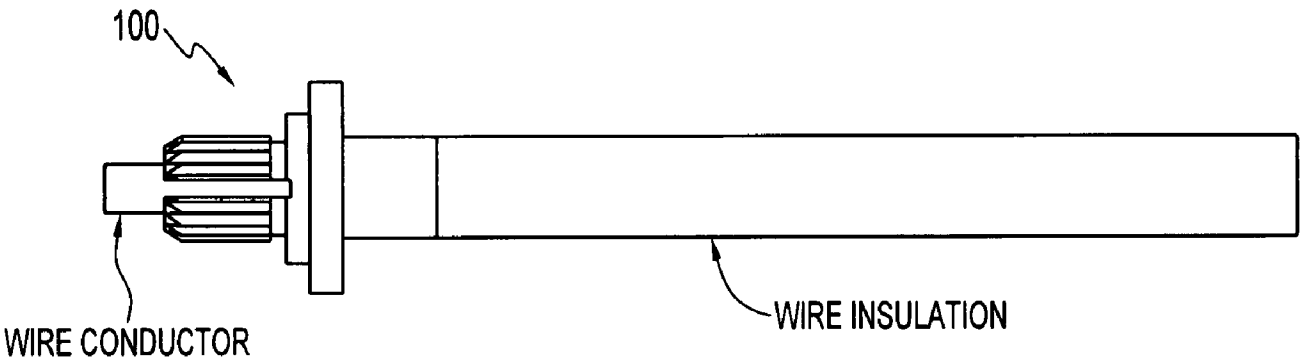
FIG. 5 illustrates a longitudinal side view of the electrical connector apparatus depicted in FIGS. 1-4, with a wire inserted into the aft end, which can be implemented in accordance with a preferred embodiment.
Figure 6:
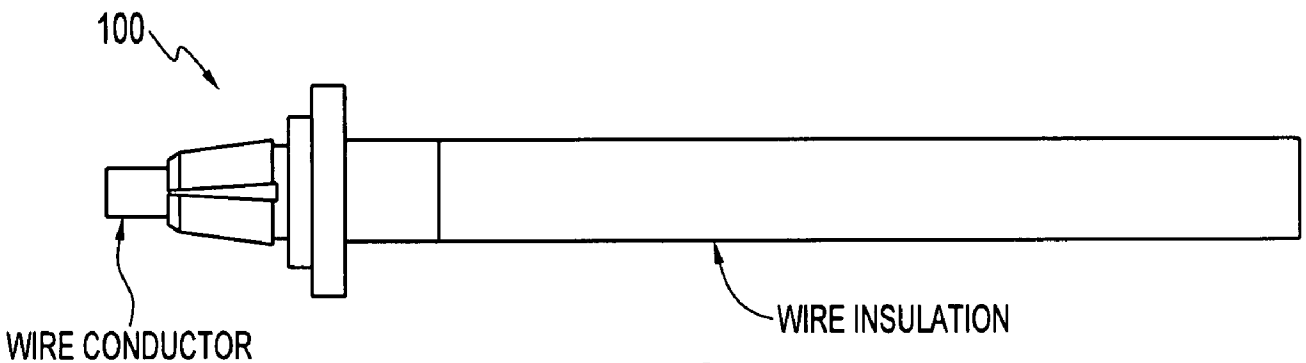
FIG. 6 illustrates a longitudinal side view of the electrical connector apparatus depicted in FIGS. 1-5, with a wire inserted into the aft end and after deformation by insertion into a toggle switch screw terminal, which can be implemented in accordance with a preferred embodiment.

FIG. 5 illustrates a longitudinal side view of the electrical connector apparatus 100 depicted in FIGS. 1-4, with a wire inserted into the aft end, which can be implemented in accordance with a preferred embodiment. FIG. 6 illustrates a longitudinal side view of the electrical connector apparatus 100 depicted in FIGS. 1-5, with a wire inserted into the aft end and after being deformed by insertion into a toggle switch screw terminal, which can be implemented in accordance with a preferred embodiment. Not shown in FIG. 6 is the toggle switch screw base. Note that in FIGS. 1-6, identical parts are indicated by identical reference numbers.

The electrical connector apparatus 100 is generally an electrically conductive cylinder with a hole 101 running through it longitudinally. In the preferred embodiment, the cylinder is constructed from a free cutting brass copper alloy, C36000. The electrical connector 100 has a slot 102 cut into the forward end 103. To complete an electrical connection to the base of a toggle switch, a wire is inserted into the aft end 104 of the electrical connector apparatus 100 until the conductor protrudes through the forward end 103 and the wire insulation butts up against the aft end 104 of the electrical connector apparatus 100 as indicated in FIG. 5.

The electrical connector apparatus 100 with the protruding conductor is then placed on top of the screw terminal insert of a toggle switch and a press is used to press the electrical connector apparatus 100 into the screw terminal already molded into the back of a toggle switch. A flange 105 is provided on the electrical connector 100 to facilitate pressing the electrical connector apparatus 100 into the screw terminal insert. The forward end 103 of the electrical connector apparatus 100 has a beveled edge 106 to assist in inserting the electrical connector apparatus 100 into a screw terminal insert on the back of a toggle switch. The preferred embodiment is a beveled edge 106 at an angle of 30 degrees.

The electrical connector apparatus 100 has a plurality of longitudinal knurls 107 on the exterior of the forward end 103 as depicted in FIGS. 1-3. This plurality of knurls 107 interferes with the threaded screw terminal insert upon insertion, retaining the electrical connector apparatus 100 in place in the toggle switch base. The slot 102 allows the electrical connector apparatus 100 to deform inward and grip the conductor securely once the insert is pressed into the screw terminal insert in the back of a toggle switch as depicted in FIG. 6.

Figure 7:
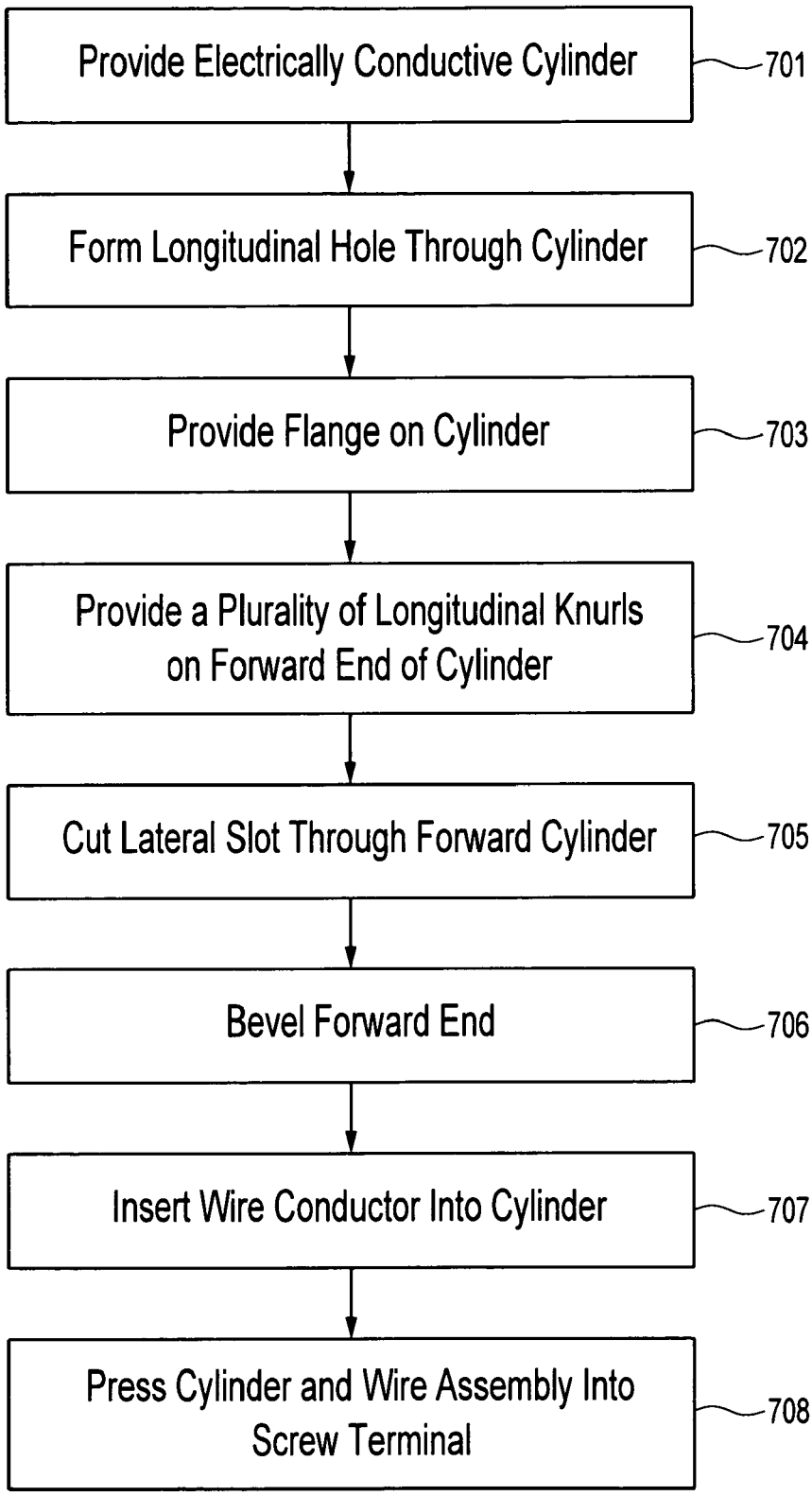
FIG. 7 illustrates a flow chart depicting a method of attaching wires securely to the back of a toggle switch while maintaining a low profile to the housing, which can be implemented in accordance with a preferred embodiment.

FIG. 7 illustrates a flow chart 700 of operations illustrating operational steps depicting a method of attaching wires securely to the back of a switch utilized in commercial, industrial and consumer applications by using an electrical connector. As depicted in block 701, an electrically conductive cylinder, with a forward end and an aft end, is provided with a longitudinal hole formed from the cylinder 702. Next as indicated in block 703, a flange is provided on the electrically conductive cylinder to facilitate pressing the electrical connector into a screw terminal. A plurality of knurls is then provided on the cylinder as depicted in block 704. Note that the plurality of knurls is formed on the electrically conductive cylinder in the longitudinal direction, i.e. parallel to the main axis of the cylinder and the longitudinal hole formed. A lateral slot is cut through the cylinder, as depicted in block 705. The lateral slot allows the walls of the cylinder to deform inward, securely gripping a wire conductor when pressed into a screw terminal.

Block 706 depicts the beveling of the forward end of the electrical connector, facilitating inserting the electrical connector into a screw terminal insert on the back of a toggle switch. The preferred embodiment is a beveled edge at an angle of 30 degrees. A wire conductor is then inserted in the electrical connector, block 707, with the wire conductor extending beyond the forward end of the electrical connector. Block 708 depicts the step of pressing the entire electrical connector with the wire conductor into a screw terminal. Pressing the electrical connector with the wire conductor inserted into the screw terminal deforms the walls of the cylinder surrounding the lateral slot inward, gripping the wire conductor securely. The plurality of knurls on the exterior causes interference with the screw terminal threads, holding the electrical connector with the wire conductor securely in place.

The combination of providing both a secure connection to the toggle switch base while securely gripping the wire conductor results in a connection that does not require a crimped-on terminal. The electrical potting may also be eliminated, significantly reducing the depth of the back of the toggle switch.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed:

1. An electrical connector apparatus, comprising:

an electrically conductive cylinder wherein said electrically conductive cylinder contains an aft end and a forward end;

a lateral slot formed from the walls of said forward end of said electrically conductive cylinder wherein said lateral slot extends laterally across a longitudinal axis of said electrically conductive cylinder, and a longitudinal hole formed through and from said electrically conductive cylinder, whereby an electrical wire, with the insulation removed, is insertable into said aft end of said electrically conductive cylinder, and wherein said wire is inserted until the wire conductor of said electrical wire extends beyond said forward end of said electrically conductive cylinder and between said walls of said lateral slot in order to achieve a secure electrical connector apparatus.

2. The apparatus of claim 1 further comprising:

a flange formed on said electrically conductive cylinder, wherein said electrically conductive cylinder is pressable into a screw terminal base by pressure on said flange.

3. The apparatus of claim 1 wherein said lateral slot deforms inward, whereby said walls of said lateral slot securely grips said wire conductor when said electrically conductive cylinder is pressed into a screw terminal base, said lateral slot deforming inwardly from external pressure on said electrically conductive cylinder from said screw terminal base.

4. The apparatus of claim 3 further comprising a plurality of knurls formed on an exterior of said forward end, wherein said plurality of knurls are formed parallel to said longitudinal hole, whereby said knurls cause frictional interference with the screw threads of said screw terminal base, securely holding said electrically conductive cylinder in said screw terminal base.

5. The apparatus of claim 1 further comprising a plurality of knurls on an exterior of said forward end, wherein said plurality of knurls is formed parallel to said longitudinal hole, whereby said knurls cause frictional interference with the screw threads of said screw terminal base, securely holding said electrically conductive cylinder in said screw terminal base.

6. The apparatus of claim 5 further comprising:

a flange formed on said electrically conductive cylinder, wherein said electrically conductive cylinder is pressable into a screw terminal base by pressure on said flange.

7. The apparatus of claim 6 wherein said lateral slot deforms inward, whereby said walls of said lateral slot securely grips said wire conductor when said electrically conductive cylinder is pressed into a screw terminal base, said lateral slot deforming from external pressure on said electrically conductive cylinder from said screw terminal base.

8. The apparatus of claim 7, further comprising:

a beveled forward end located on said electrically conductive cylinder.

9. The apparatus of claim 8 wherein said electrically conductive cylinder is composed of an alloy of brass.

10. An electrical connector apparatus, comprising:

an electrically conductive cylinder, wherein said cylinder contains an aft end and a forward end, whereby a wire conductor is insertable into said aft end and protrude from said forward end;

a lateral slot formed from a wall in said forward end of said electrically conductive cylinder wherein said lateral slot extends laterally across a longitudinal axis of said electrically conductive cylinder, and wherein said lateral slot deforms inward to grip said wire conductor, and a flange on said cylinder, wherein said electrical connector is pressable into a screw terminal by a pressure on said flange.

11. The apparatus of claim 10, further comprising:

a plurality of knurls located on an exterior of said forward end, wherein said plurality of knurls is formed parallel to said longitudinal hole.

12. The apparatus of claim 11 wherein said plurality of knurls interferes with the screw threads of said screw terminal, holding said electrical connector securely in place.

13. The apparatus of claim 12 wherein said cylinder is composed of an alloy of brass.

14. The apparatus of claim 13, further comprising:

a beveled forward end.

15. An electrical connector method comprising the steps of:

providing an electrically conductive cylinder wherein said cylinder contains an aft end, a forward end, and a longitudinal hole formed through and from said electrically conductive cylinder, whereby a wire conductor is insertable into said aft end and protrude from said forward end of said electrically conductive cylinder, said wire conductor extending between said walls of a lateral slot forming said lateral slot in said forward end of said electrically conductive cylinder wherein said lateral slot extends laterally across a longitudinal axis of said electrically conductive cylinder, whereby a wire conductor may be inserted into said aft end and protrude from said forward end, wherein said lateral slot deforms inward to grip said wire conductor when pressed into a screw terminal, said lateral slot deforming from external pressure on said electrically conductive cylinder from said screw terminal;

providing a plurality of knurls on said forward end; and beveling the forward end of said electrical connector.

16. The method of claim 15, wherein a flange is provided on said cylinder, wherein said electrical connector apparatus is pressable into said screw terminal base by pressure on said flange.

17. The method of claim 16, wherein said plurality of knurls is formed parallel to said longitudinal hole.

18. The method of claim 17, wherein said lateral slot deforms inward to grip said wire conductor when pressed into a screw terminal.

19. The method of claim 18, wherein said plurality of knurls interferes with said screw threads of said screw terminal, thereby holding said electrical connector securely in place.

20. The method of claim 19, wherein said electrically conductive cylinder is composed of an alloy of brass.

* * * * *